US007253779B2

(12) United States Patent
Greer et al.

(10) Patent No.: US 7,253,779 B2
(45) Date of Patent: Aug. 7, 2007

(54) MULTIPLE ANTENNA DIVERSITY FOR WIRELESS LAN APPLICATIONS

(75) Inventors: Kerry L. Greer, Melbourne Beach, FL (US); Frank M. Caimi, Vero Beach, FL (US); Jason M. Hendler, Indian Harbour Beach, FL (US); Jay A. Kralovec, Meblourne, FL (US)

(73) Assignee: SkyCross, Inc., Viera, FL (US)

( * ) Notice: Subject to any disclaimer, the term of this patent is extended or adjusted under 35 U.S.C. 154(b) by 18 days.

(21) Appl. No.: 10/313,971

(22) Filed: Dec. 6, 2002

(65) Prior Publication Data

US 2003/0146876 A1 Aug. 7, 2003

Related U.S. Application Data

(60) Provisional application No. 60/364,922, filed on Mar. 15, 2002, provisional application No. 60/338,252, filed on Dec. 7, 2001.

(51) Int. Cl.
*H01Q 11/12* (2006.01)

(52) U.S. Cl. ..... 343/744

(58) Field of Classification Search ..... 343/741, 343/744, 745, 700 MS, 829, 846
See application file for complete search history.

(56) References Cited

U.S. PATENT DOCUMENTS

| | | | | |
|---|---|---|---|---|
| 4,538,153 | A * | 8/1985 | Taga | 343/700 MS |
| 5,293,176 | A | 3/1994 | Elliot | 343/797 |
| 5,486,836 | A * | 1/1996 | Kuffner et al. | 343/700 MS |
| 5,491,723 | A * | 2/1996 | Diepstraten | 375/267 |
| 5,680,144 | A | 10/1997 | Sanad | 343/700 MS |
| 5,740,526 | A * | 4/1998 | Bonta et al. | 455/277.2 |
| 5,790,080 | A | 8/1998 | Apostolos | 343/744 |
| 5,880,695 | A | 3/1999 | Brown et al. | |
| 5,923,296 | A | 7/1999 | Sanzgiri et al. | |
| 5,926,137 | A | 7/1999 | Nealy | 343/700 MS |
| 6,023,244 | A | 2/2000 | Snygg et al. | |
| 6,057,802 | A | 5/2000 | Nealy et al. | 343/700 MS |
| 6,166,694 | A | 12/2000 | Ying | 343/702 |
| 6,300,906 | B1 | 10/2001 | Rawnick et al. | |
| 6,320,544 | B1 | 11/2001 | Korsich et al. | |
| 6,429,820 | B1 * | 8/2002 | Thursby et al. | 343/744 |
| 6,456,245 | B1 * | 9/2002 | Crawford | 343/702 |
| 6,486,844 | B2 * | 11/2002 | Thursby et al. | 343/744 |
| 6,489,925 | B2 * | 12/2002 | Thursby et al. | 343/700 MS |
| 6,590,543 | B1 * | 7/2003 | Apostolos | 343/742 |
| 6,597,321 | B2 * | 7/2003 | Thursby et al. | 343/744 |
| 6,757,267 | B1 * | 6/2004 | Evans et al. | 370/334 |
| 6,778,844 | B2 * | 8/2004 | Hood, III | 455/562.1 |
| 6,853,336 | B2 * | 2/2005 | Asano et al. | 343/702 |
| 2002/0000938 | A1 * | 1/2002 | Hoashi et al. | 343/700 MS |
| 2002/0044089 | A1 * | 4/2002 | Yokogi | 343/700 MS |

FOREIGN PATENT DOCUMENTS

GB 2 067 842 A 12/1980

* cited by examiner

*Primary Examiner*—Shih-Chao Chen
*Assistant Examiner*—Minh Dieu A
(74) *Attorney, Agent, or Firm*—John L. DeAngelis; Beusse, Wolter, Sanks, Mora & Maire, P.A.

(57) ABSTRACT

An antenna system comprising a plurality of antennas designed and oriented to provide one or more of radiation pattern, signal polarization and spatial diversity. The various diversity operational characteristics are achieved by using similar antennas physically oriented to provide the diversity attributes or by using dissimilar antennas, that is, antennas having different radiation pattern and/or signal polarization characteristics.

15 Claims, 10 Drawing Sheets

MULTIPLE ANTENNA DIVERSITY FOR WIRELESS LAN APPLICATIONS

The present invention claims the benefit of the provisional patent application filed on Dec. 7, 2001, assigned application No. 60/338,252, and the provisional patent application filed on Mar. 15, 2002, assigned application No. 60/364,922.

FIELD OF THE INVENTION

The present invention relates generally to antennas for receiving and transmitting radio frequency signals, and more specifically to such antennas that provide three-dimensional spatial diversity, signal polarization diversity and radiation pattern diversity for receiving and transmitting radio frequency signals.

BACKGROUND OF THE INVENTION

It is generally known that antenna performance is dependent on the antenna size, shape and the material composition of certain antenna elements, as well as the relationship between the wavelength of the received/transmitted signal and certain antenna physical parameters (that is, length for a linear antenna and diameter for a loop antenna). These relationships and physical parameters determine several performance characteristics, including: input impedance, gain, directivity, polarization and radiation pattern. Generally, for an operable antenna, the minimum effective electrical length (which according to certain antenna structures, for example antennas incorporating slow wave structures, may not be equivalent to the antenna physical length) must be on the order of a quarter wavelength or a multiple thereof of the operating frequency. A quarter-wave antenna limits the energy dissipated in resistive losses and maximizes the energy transmitted. Quarter and half wavelength antennas are the most commonly used.

The radiation pattern of the half-wavelength dipole antenna is the familiar omnidirectional donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical antenna gain is about 2.15 dBi.

The quarter-wavelength monopole antenna placed above a ground plane is derived from a half-wavelength dipole. The physical antenna length is a quarter-wavelength, but when placed above a ground plane the antenna performance resembles that of a half-wavelength dipole. Thus, the radiation pattern for a quarter-wavelength monopole antenna above a ground plane is similar to the half-wavelength dipole pattern, with a typical gain of approximately 2 dBi.

Printed or microstrip antennas are constructed using the principles of printed circuit board techniques, where one or more of the metallization layers or interconnecting vias serve as the radiating element(s). These antennas are popular because of their low profile, ease of manufacture and low fabrication cost. One such antenna is the patch antenna, comprising a ground plane below a dielectric substrate, with the radiating element overlying the substrate top surface. The patch antenna provides directional hemispherical coverage with a gain of approximately 3 dBi.

The burgeoning growth of wireless communications devices and systems has created a need for physically smaller, less obtrusive and more efficient antennas that are capable of wide bandwidth and/or multiple frequency operation. As the size of physical enclosures for pagers, cellular telephones and wireless Internet access devices shrink, manufacturers continue to demand improved performance, multiple operational modes and smaller sizes for today's antennas.

Smaller packaging envelopes do not provide sufficient space for the conventional quarter and half wavelength antenna elements. Also, as is known to those skilled in the art, there is a direct relationship between antenna gain and antenna physical size. Increased gain requires a physically larger antenna, while users continue to demand physically smaller antennas with increased gain.

With the expansive deployment of computer resources, it has become advantageous to connect computers to allow collaborative sharing of information. Conventionally, the connection is in the form of wired computer or data networks (generally referred to as local area networks or LAN's) operating under various standard protocols, such as the Ethernet protocol. Users connected to the network can exchange data with other network users, irrespective of the physical distance between, the users. These networks, which have become ubiquitous among computer users, operate at fairly high speeds, up to about 1 Gbps, using relatively inexpensive hardware. However, LANs are limited to the physical, hard-wired infrastructure of the structure in which the users are located.

During recent years, the market for wireless communications of all types has enjoyed tremendous growth. Wireless technology allows people to exchange information using pagers, cellular telephones, and other wireless communication products. With the steady expansion of wireless communications, wireless concepts are now being applied to data networks, relieving the user of the need for a wired connection between the computer and the network.

The major motivation and benefit from wireless LANs is the user's increased mobility. Untethered from conventional network connections, network users can access the LAN from wireless network access points strategically located within a structure or on a campus. Depending on the antenna gain, available signal power, noise and interference, wireless local area networks can operate over a range of several hundred feet to a few thousand feet. Frequently it is more economical to install a wireless LAN than to install a wired network in an existing structure. Wireless LANs offer the connectivity and the convenience of wired LANs without the need for expensive wiring or rewiring.

The Institute for Electrical and Electronics Engineers (IEEE) standard for wireless LANs (IEEE 802.11) sets forth two different wireless network configurations: ad-hoc and infrastructure. In the ad-hoc network, computers are brought together to form a network "on the fly." There is no structure to the network and there are no fixed network points. Typically, every node is able to communicate with every other node. The infrastructure wireless network uses fixed wireless network access points with which mobile nodes can communicate. These wireless network access points are typically bridged to landlines to allow users to access other networks and sites not on the wireless network.

The IEEE 802.11 standard governs both the physical (PHY) and medium access control (MAC) layers of the network. The PHY layer, which handles the transmission of data between nodes, can use either direct sequence spread spectrum, frequency-hopping spread spectrum, or infrared (IR) pulse position modulation. IEEE 802.11 makes provisions for data rates of either 1 Mbps or 2 Mbps, and calls for operation in the 2.4-2.4835 GHz frequency band (which is an unlicensed band for industrial, scientific, and medical (ISM) applications) and 300-428,000 GHz for IR transmission.

The MAC layer comprises a set of protocols that maintain order among the users accessing the network. The 802.11 standard specifies a carrier sense multiple access with collision avoidance (CSMA/CA) protocol. In this protocol, when a node receives a packet for transmission over the network, it first listens to ensure no other node is transmitting. If the channel is clear, the node transmits the packet. Otherwise, the node chooses a random "backoff factor" that determines the amount of time the node must wait until it is allowed to retry the transmission.

Several extensions of the IEEE 802.11 standard have been developed. The first, referred to as 802.11a, provides a data rate of up to 54 Mbps in the 5 GHz frequency band. The 802.11a standard requires an orthogonal frequency division multiplexing encoding scheme, rather than the frequency hopping and direct sequence spread schemes of 802.11. The 802.11b standard (also referred to as 802.11 high rate or Wi-Fi) provides a 11 Mbps transmission data rate, with a fallback to data rates of 5.5, 2 and 1 Mbps. The 802.11b scheme uses the 2.4 GHz frequency band, using direct sequence spread spectrum signaling. Thus 802.11b provides wireless functionality comparable to the Ethernet protocol. The newest standard, 802.11g provides for a data rate of 20+ Mbps in the 2.4 GHz band. A primarily European wireless networking standard similar to the 802.11 standards, referred to as HyperLAN2, operates at 5.8 MHz.

Today, devices implementing either the 802.11a or 802.11b standard are available. The higher data rate of 802.11a devices can support bandwidth hungry applications, but the higher operating frequency limits the radio range of the transmitting and receiving units. Typically, 802.11a compliant radios can deliver 54 Mbps at distances of about 60 feet, which is far less than the 300 feet radio range over which the 802.11b systems can operate, albeit at lower data rates. Thus 802.11a installations require a larger number of media access points from which users link into the network.

Recognizing the transient nature of a wireless signal link due to movement of the communicating devices relative to each other (typically, the base station antenna is permanently mounted while the portable device with its attendant antenna is movable relative to the base station antenna), and the time varying properties of noise that can affect system performance, various schemes have been proposed to ensure that signals are received over the link with a sufficient ratio of bit energy to noise spectral density to allow recovery of the data. Antenna spatial diversity is one such scheme, employing two antennas at the transmitting and/or receiving device, with selection of the operative antenna based on one or more monitored signal quality metrics. Thus, for example, the antenna providing the largest signal power or signal-to-noise ratio can be selected as the operative antenna. The primary objective of an antenna diversity system is to reduce signal fading caused by multipath signals that can coherently cancel at the antenna, thereby reducing the received signal quality and making signal decoding more difficult and prone to error. For example, as a portable unit employing a single antenna is moved or as the signal path changes dynamically in length and/or angle due to motion of the scattering or reflecting surfaces relative to the portable unit, the multipath signals received at the antenna can destructively interfere. (The signals can also constructively interfere.) In addition, the transmission medium itself (the atmosphere) can produce variations that are manifest as fades at a receiver employing only a single antenna.

In the prior art spatial diversity system the maximum allowable distance between the antennas is dependent on the available space. For example, if the antennas and associated receiving and transmitting circuitry are assembled onto a PCMCIA card for insertion into a laptop computer, then the separation will be on the order of a few inches. If the antennas are mounted for use with a desktop computer the spatial separation can be on the order of several inches or a few feet. Although these dimensions can be on the order of a fraction of a wavelength at current wireless frequencies, the use of spatially diverse antennas can still achieve improved performance.

The signals received at two spatially diverse antennas differ in phase and amplitude due to the distance between the antennas. The two received signals can be summed to produce a stronger received signal, or a selection process can determine, based on one or more predetermined received signal metrics, which of the two antenna signals should provide the input to the receiver circuitry (or which of the two antennas should transmit the signal). Monopole antennas above a ground plane or dipole antennas are conventionally used in these spatial antenna diversity applications.

If a multipoint reception system is used (often called a multi-branch reception system in the art), and the signals are uncorrelated at each branch (for instance, by using separate diverse locations for the antenna reception points as discussed above) the signal fading problem can be reduced. This fade reduction results from the statistical independence of the signal branches, so that as one branch fades, the probability that the other branch is also fading is small.

Polarization diversity is achieved using two linearly polarized antennas mounted orthogonally. Thus the diversity scheme relies upon the independent polarization of two or more reception branches to achieve a reduction in signal fading. The statistical independence of the branches is due to the changes in electromagnetic wave polarization as the waves are scattered and reflected along different propagation paths to the receiving antenna.

BRIEF SUMMARY OF THE INVENTION

An antenna system provides various diversity characteristics according to the teachings of the present invention. Signal polarization diversity is provided by differential orientation of two similar antennas or by the use of antennas having different signal polarization. Spatial diversity is achieved by placing the antennas in a spaced-apart configuration. Radiation pattern diversity results from the use of two antennas with different patterns or by opposingly orienting two antennas with the same radiation pattern.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
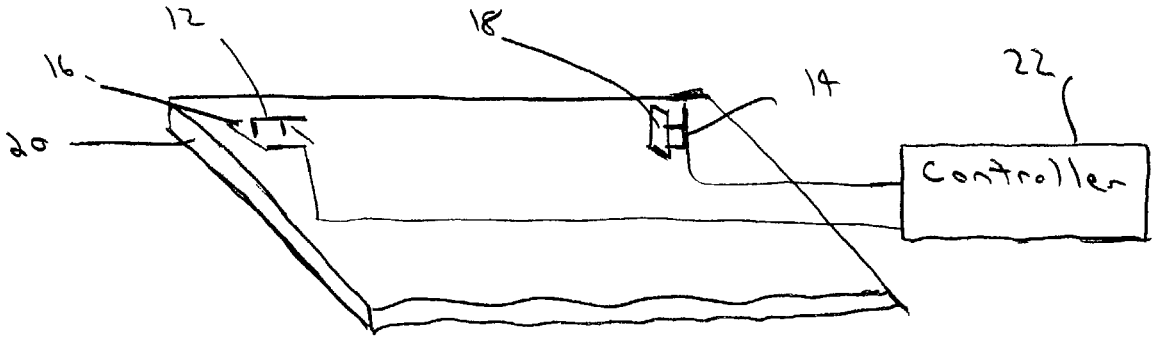
FIG. 1 illustrates two meanderline loaded antennas operative in an antenna diversity system.

Before describing in detail the particular antenna diversity scheme in accordance with the present invention, it should be observed that the present invention resides primarily in a novel combination of hardware elements related to an antenna diversity system. Accordingly, the hardware elements have been represented by conventional elements in the drawings, showing only those specific details that are pertinent to the present invention, so as not to obscure the disclosure with structural details that will be readily apparent to those skilled in the art having the benefit of the description herein.

According to the teachings of the present invention, an antenna system comprises two or more antennas providing diversity reception and transmission, in one embodiment, through radiation pattern diversity. The resulting operational robustness has not heretofore been achievable with prior art spatial diversity antenna systems. The present invention offers antenna gain achievable by the appropriate selection of a receiving/transmitting branch, where each branch represents an antenna exhibiting different radiation patterns. That is, antennas exhibiting different patterns, if individually designed for efficient operation, have gain in excess of an isotropic antenna, and can effectively increase the signal energy received from (or transmitted to) a particular direction. If the antenna selected from among one or more radiation pattern diverse antennas has gain in the desired direction, then an advantage is obtained over an isotropic (unity gain) antenna and over two spatially diverse antennas. For example, it is known that the radiation pattern of an antenna transmitting in free space is different from the pattern of the same antenna transmitting in a structure with a plurality of interior walls. Thus a receiving antenna system providing pattern diversity can overcome the effects of radiation pattern distortions from the transmitter by providing a selectable radiation pattern at the receiver.

The radiation pattern diversity of the present invention is based on the use of two or more antennas with minimally or non-overlapping (i.e., different) radiation patterns to provide better overall pattern coverage for the communications device with which the antennas are associated. In one embodiment, the two pattern diverse antennas comprise a monopole antenna above a ground plane, with the familiar donut shape pattern, and a patch antenna with maximum radiation substantially perpendicular to the plane of the patch. In another embodiment the radiation pattern diverse antennas comprise similar antennas having similar radiation patterns, but physically oriented along different axes such that the radiation patterns are diverse. For example, two patch antennas offset by 90 degrees provide pattern diversity with one antenna beam in the vertical direction and the other directed in the azimuth direction, albeit subtending a relatively small arc in the azimuth direction.

In another embodiment the two dissimilar antennas are oriented to provide signal polarization diversity, so that both pattern and polarization diversity are achieved. The patch antenna and the monopole above a ground plane can be mounted with different orientations to transmit or receive differently polarized signals. Also, two monopole antennas displaced by 90 degrees with respect to each other provide signal polarization diversity.

Thus the antenna system of the present invention offers multiple antenna diversity (i.e., combinations of one or more of signal polarization, radiation pattern (or gain) and spatial diversity) according to the teachings of the present invention. As applied to PCMCIA cards, for instance, the employed antennas according to the present invention are physically small, and therefore suitable for mounting in the limited space envelope of a PCMCIA card for use in the wireless applications described above. Thus multiple reception/transmission branches or paths, providing a combination of one or more of signal polarization, radiation pattern and spatial diversity, is possible in the limited space afforded by the PCMCIA card, with commensurate performance improvement of the communications device operative with the antenna system of the present invention.

Conventional wireless local area networks as described above often provide for the use of two antennas at the portable or mobile unit, by including two antenna ports. Thus an antenna system according to the present invention where two antennas are designed and/or oriented to provide signal polarization or radiation pattern diversity can be connected to the antenna ports to improve performance. Additionally, the antennas can be placed in spatially diverse locations to provide spatial diversity.

According to the present invention, therefore, combined diversity attributes are provided to offer as many different signal states as possible, by increasing the number of diversity branches available in a small space. The more signal states or branches that are available, the lower the probability that a received signal cannot provide a acceptable power to noise ration to allow accurate decoding.

The physically small meanderline antennas described below, when used in a diversity system of the present invention, offer additional space reductions, plus the signal polarization and radiation pattern diversity not available in the prior art. These meanderline antennas can also be separated in space to achieve the added advantage afforded by spatial separation/diversity.

According to one embodiment of the present invention, the antennas employed to provide the beam pattern and the signal polarization diversity can be constructed as meanderline-loaded antennas, wherein variable impedance transmission lines, also referred to as meanderlines, interconnect various radiating elements so that the antenna can be constructed in a physically smaller volume while offering acceptable performance parameters at the desired operating frequency or frequencies. Meanderline antennas that can be used in this embodiment include those described in the following issued patent and patent applications, all of which are incorporated herein by reference: U.S. Pat. No. 5,790,080, entitled MeanderLine Loaded Antenna; the commonly-owned pending U.S. patent application entitled Low Profile, High Gain Frequency Tunable Variable Impedance Transmission Line Loaded Antenna filed on May 31, 2001 bearing application Ser. No. 09/871,201; and commonly-assigned U.S. Pat. No. 6,429,820 entitled High Gain, Frequency Tunable Variable Impedance Transmission Line Loaded Antenna Providing Multi-Band Operation.

As discussed in the references, these antennas provide frequency-dependent radiation pattern characteristics. For example, at certain frequencies or within certain frequency bands the meanderline antenna produces substantial radiation from the side elements and thus the radiation pattern is the familiar omnidirectional donut pattern. At a different frequency, the same antenna operates in a mode such that the majority of the radiation is produced substantially in the elevation direction.

Polarization diversity is achieved by mounting one of the meanderline loaded antennas in a vertical orientation with the other mounted in a horizontal orientation. Although this physical configuration provides maximum signal polarization differentiation, other antenna orientations can be employed to offer the desired degree of polarization diversity.

Thus, using these meanderline-loaded antennas in an antenna diversity arrangement offers nearly unlimited possibilities for radiation pattern, signal polarization, and spatial diversity, operating in combination. That is, the radiation pattern, location, and signal polarization characteristics of the antennas can be established to produce the desired antenna performance characteristics in any one or more of three dimensions with the objective of improving performance of the receiving or transmitting communications device.

FIG. 1 illustrates an exemplary embodiment where two meanderline loaded antennas 12 and 14 (including their respective ground planes 16 and 18) are mounted to a circuit card 20, such as a PCMCIA card for providing wireless communicating capabilities for a laptop computer. In another embodiment, the ground planes surfaces of the circuit card are employed and thus the separate ground planes 16 and 18 are not required. The meanderline-loaded antenna 12 is mounted horizontally to provide a horizontally polarized signal and the meanderline loaded antenna 14 is mounted vertically to provide vertical polarization, i.e., for receiving vertically polarized signals with minimized losses or transmitting vertically polarized signals.

Further, switching between the meanderline loaded antennas 12 and 14 or taking a weighted sum of the signal each receives provides a degree of radiation pattern diversity not available in the prior art. The meanderline loaded antennas 12 and 14 are also spaced apart by a fraction of a wavelength to provide spatial diversity.

A controller 22 responsive to the meanderline loaded antennas 12 and 14 provides the switching or summing functions on the signals received by or transmitted from the meanderline loaded antennas 12 and 14 to optimize the signal according to a selected signal quality metric. The elements of the controller 22, whether implemented in software or hardware are known in the art. In the application where the meanderline loaded antennas 12 and 14 are mounted to a circuit card 20, as illustrated in FIG. 1, the controller 22 can be collocated on the card 20 or implemented in software within the laptop computer with which the PCMCIA card operates.

Figure 2:
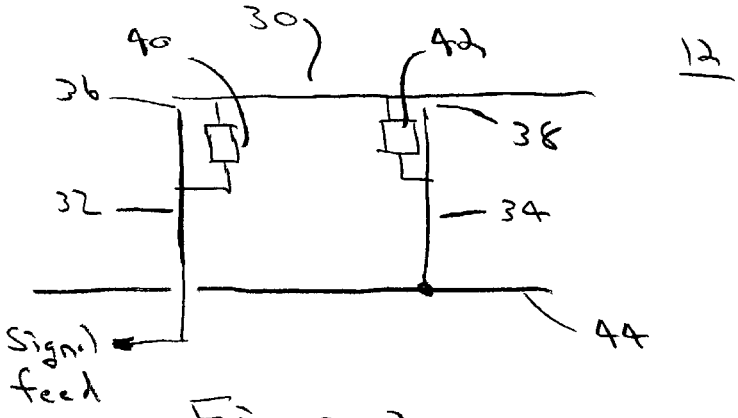
FIG. 2 illustrates a meanderline loaded antenna suitable for inclusion in the system of FIG. 1.

One example of a meanderline loaded antenna 12 is illustrated in FIG. 2, wherein the meanderline loaded antenna 12 comprises a horizontal element 30 spaced apart from two vertical elements 32 and 34, creating gaps 36 and 38 therebetween. Meanderline couplers (that is, variable impedance transmission lines) 40 and 42 are electrically connected across the gaps 36 and 38, respectively. A ground plane 44 is also shown. In this embodiment the signal is fed to the meanderline loaded antenna 12 (or received from when operative in the receiving mode) through the vertical element 32; the vertical element 34 is connected to the ground plane 44. Other meanderline antennas, including those set forth in the referenced issued patents and patent applications can be used in lieu of the meanderline loaded antenna 12.

Figure 3:
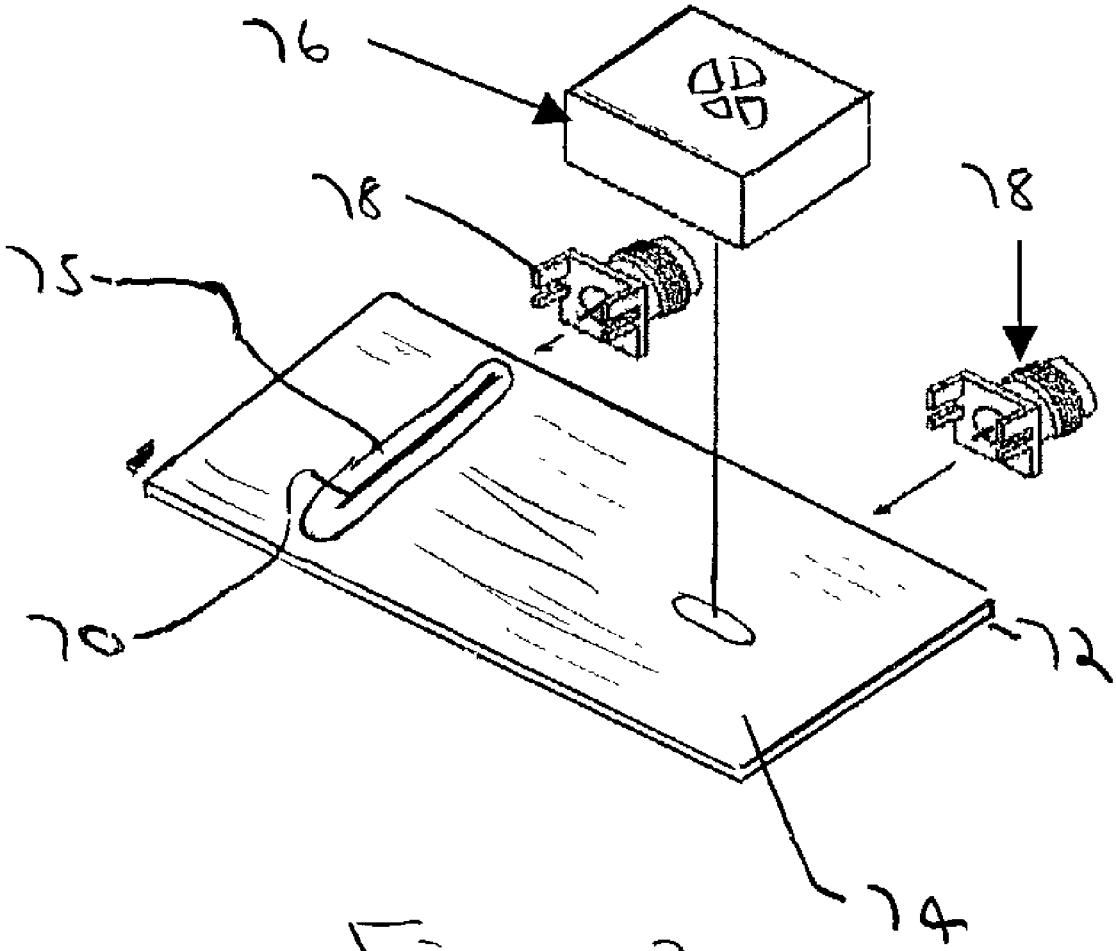
FIG. 3 illustrates another embodiment of an antenna diversity system according to the teachings of the present invention.

FIG. 3 illustrates a monopole antenna 70 comprising a substantially linear radiating or launching element disposed on a printed circuit board 72, having a ground plane 74 formed thereon. A region 75 of the ground plane 74 is removed in the vicinity of the monopole antenna 70 as shown.

A monopole antenna 76 (for instance a Goubau antenna) is disposed perpendicular to the printed circuit board 72. The radiation pattern of the antenna 76 is omnidirectional in the azimuth plane, i.e., the donut pattern, with the axis of the pattern perpendicular to the printed circuit board 72. The signal is vertically polarized.

One example of a Goubau antenna suitable for use as the monopole antenna 76 is illustrated in FIGS. 4 through 7. This antenna offers a low cost, monolithic, surface mountable, antenna for integration into receive and transmit mother boards, e.g., PCMCIA cards. Further details of the Goubau antenna can be found in the commonly-owned provisional patent application entitled, Apparatus and Method for Forming a Monolithic Surface-Mountable Antenna, filed on Aug. 22, 2002 and assigned application No. 60/405,039, which is hereby incorporated by reference.

Figure 4:
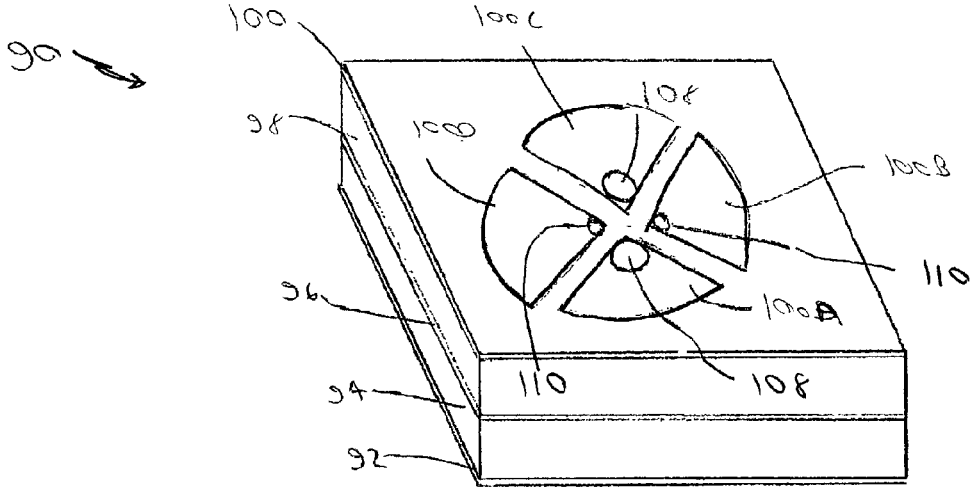
FIGS. 4-7 illustrate various views and internal elements of an antenna suitable for operation in the antenna diversity system of FIG. 3.

FIG. 4 is a perspective view of a Goubau antenna 90 comprising in stacked relation a ground plane 92, a dielectric layer 94, a conductive mid-layer 96, a dielectric layer 98 and a top layer 100. The top layer 100 comprises a plurality of conductive segments 100A through 100D. Two opposing segments 100A and 100C are electrically connected to the ground plane 92 by way of conductive ground vias 108. Two opposing segments 100B and 100D are each connected to a conductive signal via 110, each of which is in turn responsive to the signal to be transmitted in the transmitting mode and provides the received signal in the receiving mode. The conductive vias 108 and 110 are interconnected in the conductive mid-layer 96 as will be further described below. The ground plane 92 and the top layer 100 are formed from printed circuit board material that has been masked, patterned and etched to form the desired features. In the transmit mode, the conductive vias 108 and 110 are the primary radiating elements. In the receiving mode, they are the primary receiving elements.

Figure 5:
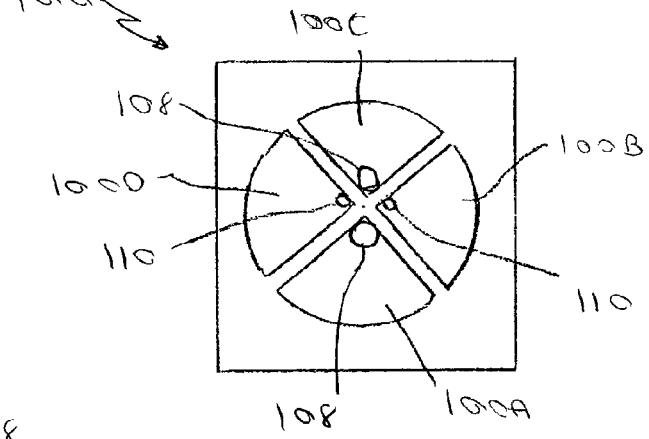

FIG. 5 is a top view of the top layer 100. It is clear from this figure that the signal vias 110 are slightly smaller in diameter than the ground vias 108, although this is not necessarily required for operation of the antenna 90. Although the four conductive segments 100A-100D are illustrated, other embodiments can have more or fewer conductive segments and corresponding desirable operating characteristics. For example, the antenna radiation resistance is a direct function of the square of the number of segments. As the radiation resistance increases relative to the antenna reactance (energy stored in the antenna and not radiated), the Q factor of the antenna declines and the operational bandwidth increases.

Figure 6:
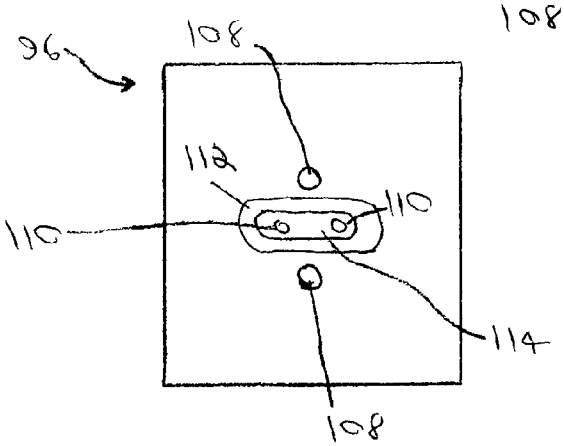

FIG. 6 is a bottom view, illustrating the ground plane 92, the ground vias 108 and the signal vias 110. As can be seen, there is a region 112, surrounding the signal vias 110, from which the conductor forming the ground plane 92 has been removed. Within the region 112 a conductive pad 114 interconnects the signal vias 110. Thus in the transmitting mode a signal is supplied to the antenna 90 between the ground plane 92 and the signal vias 110 (which are electrically identical to the conductive pad 114). In the receiving mode the received signal is supplied between these same two points.

Figure 7:
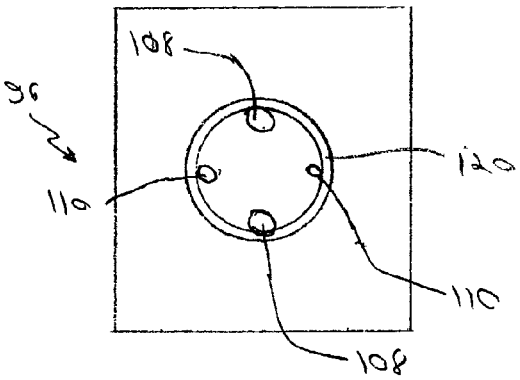

FIG. 7 is a top view of the conductive mid-layer 96, including a conductive trace 120 interconnecting the ground vias 108 and the signal vias 110.

As described above, the antenna 90 displays an omnidirectional pattern in the azimuth direction, with most of the energy radiated from the ground vias 108 and the signal vias 110. Little energy is radiated from the top plate 100 and the ground plane 92.

Returning to FIG. 3, radio frequency connectors 78 electrically connected to the monopole antennas 70 and 76 (and connected to the ground plane 74) provide the signal to be transmitted by the antennas when operative in the transmitting mode and provide the received signals to receiving circuitry when operative in the receive mode. In another embodiment, the connectors 78 are replaced by conductive traces formed on the printed circuit board 72. For example, if the printed circuit board 72 comprises a PCMCIA card for insertion into a laptop computer for operation in conjunction with a wireless LAN, the antennas 70 and 76 are connected to signal receiving and transmitting circuitry via conductive traces on the printed circuit board 72.

The radiation pattern of the monopole antenna 70 is the familiar omnidirectional donut pattern with the donut in a vertical plane, i.e., the axis of the pattern parallel to the plane of the printed circuit board 72. The radiation pattern of the monopole antenna 76 is also a donut pattern but the donut is in the horizontal plane, i.e., substantially parallel to the plane of the printed circuit board 72. The use of the two antennas 70 and 76 in a switched configuration provides for switched radiation pattern diversity, in this embodiment more specifically referred to as switched spherical pattern diversity, because the combined radiation pattern of the antennas 70 and 76 approximates a sphere. To determine which of the two antennas offers better operation, when operative in the receiving mode a signal performance metric is determined for the received signal using each of the antennas 70 and 76. The antenna providing the better metric value is selected as the receiving antenna. This function can be performed by the aforementioned control circuitry 22. A similar signal metric determination is made when the monopole antennas 70 and 76 are operative in the transmitting mode, at a receiving device separated from the antennas 70 and 76. A signal is returned to the transmitter to advise which of the two antennas 70 and 76 is providing the better received signal. This antenna is then selected as the transmitting antenna by operation of the controller 22. It is noted that because the antennas 70 and 76 are physically separated, they also provide spatial diversity, and thus the measured signal metric is influenced by the spatial location of each antenna relative to the incoming or outgoing signal. The monopole antennas also provide signal polarization diversity because they are oriented perpendicular with respect to each other.

Figure 8:
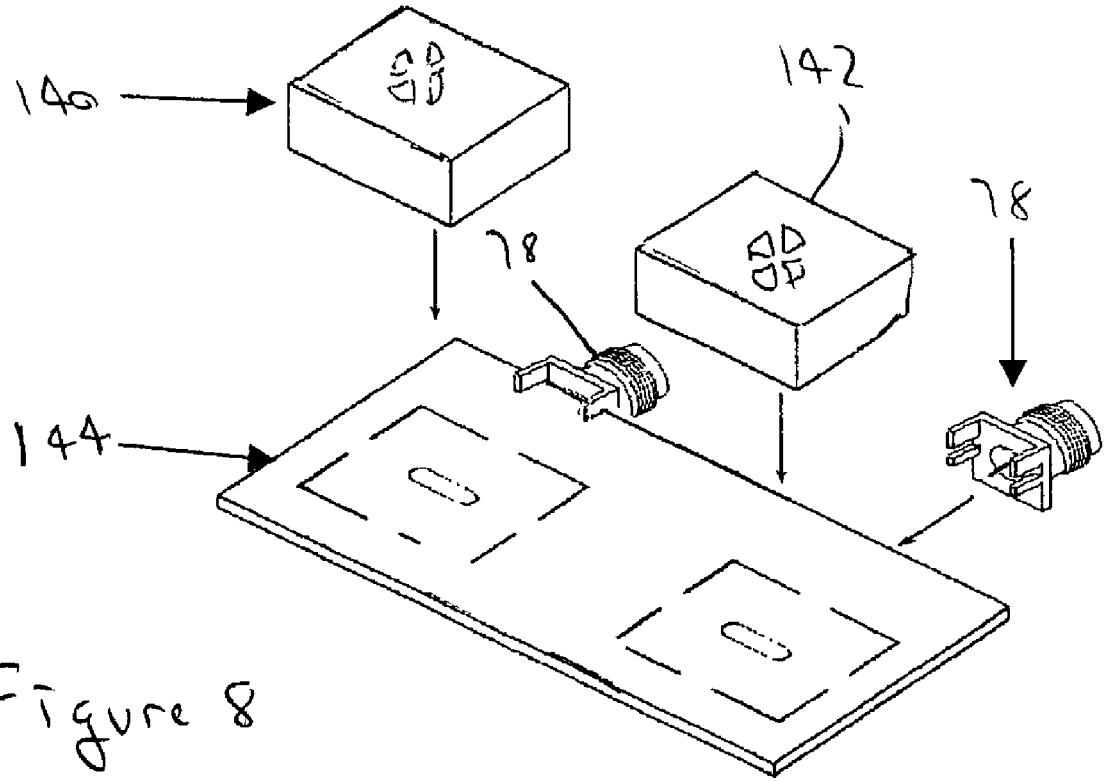
FIG. 8 illustrates another embodiment of an antenna diversity system according to the teachings of the present invention.

According to the embodiment of FIG. 8, two monopole antennas 140 and 142 (for example, implemented as the Goubau antenna 90 described above), which exhibit a relatively wide operational bandwidth, are mounted on a printed circuit board 144, which also serves as a ground plane. The radiation pattern of each antenna 140 and 142 is a donut pattern, with both patterns oriented parallel to the plane of the printed circuit board 144. Since the two antennas are spatially separated, they offer a switched spatial diversity for an incoming or outgoing signal. For example, due to the signal fading affects discussed above, a signal null may occur at the antenna 140. In which case, the antenna 142 is switched to the operative mode to receive the incoming signal. As referred to above for the antennas of FIG. 3, other signal metric parameters can be used to determine the operative antenna between the antennas 140 and 142. In another embodiment, not illustrated, one of the antennas 140 and 142 can be rotated by 90 degrees so that the axis of the donut patter is parallel to the plane of the printed circuit board 144 to provide radiation pattern diversity.

Figure 9:
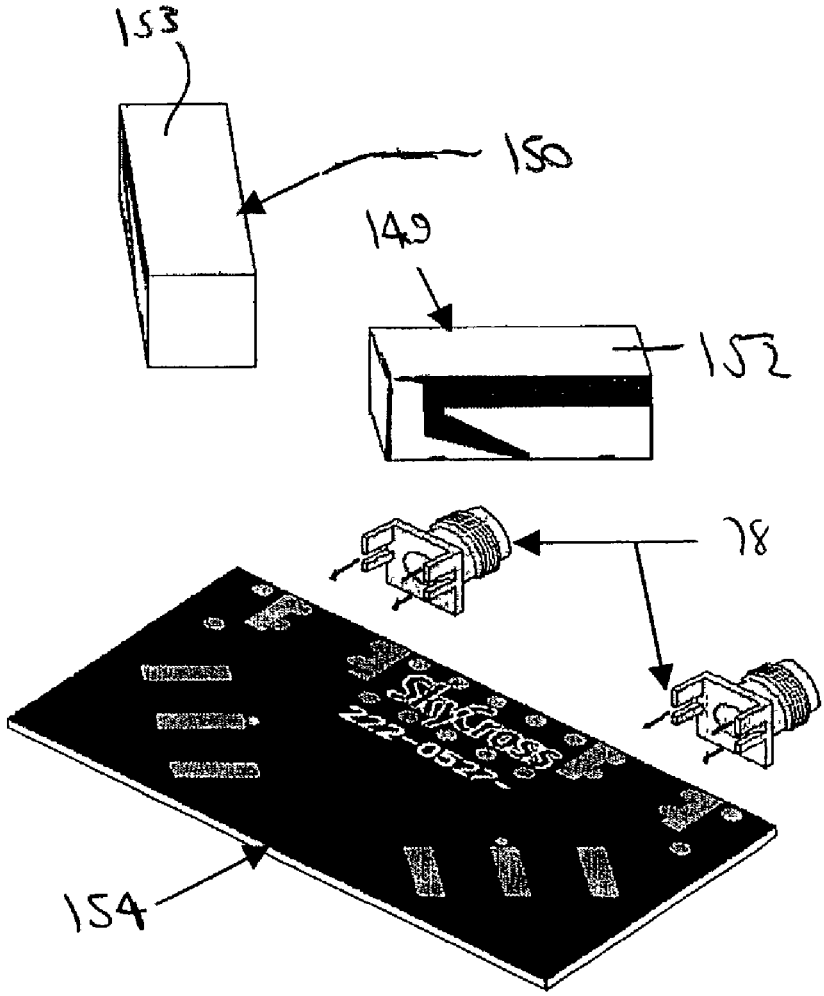
FIG. 9 illustrates another embodiment of an antenna diversity system according to the teachings of the present invention.

FIG. 9 illustrates two antennas 149 and 150 that each transmit (or receive) a highly linearly polarized signal from their top surfaces 152 and 153, respectively, in a relatively narrow beam toward the zenith. Although the radiation patterns of the antenna 149 and 150 slightly overlap, the antennas are oriented orthogonal to each other to provide signal polarization diversity in the zenith direction. This embodiment is recommended for applications in which the required beam angle is narrow, but the polarity of the received signal is unknown due to signal scattering between the transmitter and the receiver. The antennas 149 and 150 are mounted on a printed circuit board 154, which also provides a ground plane function.

Figure 10:
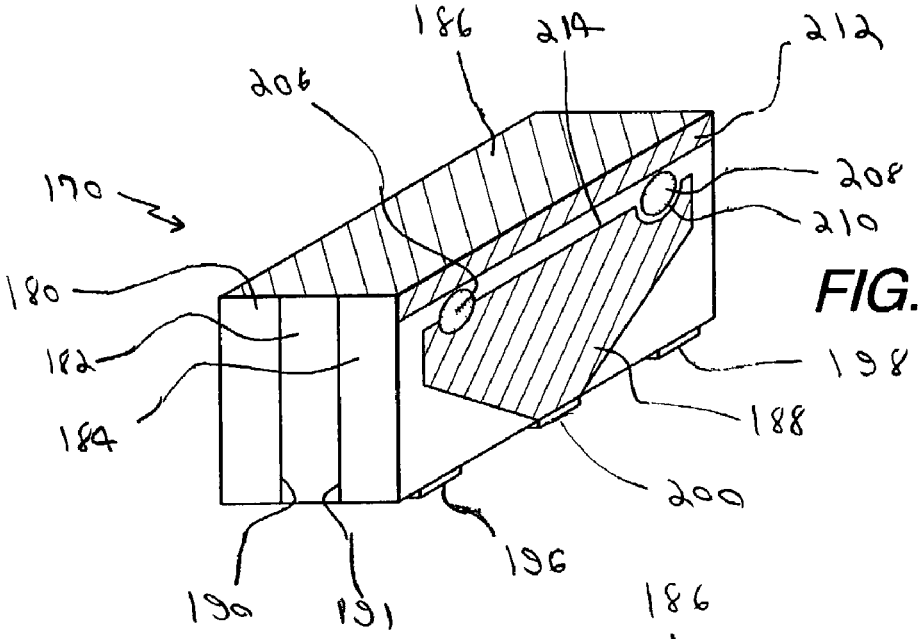
FIGS. 10-15 illustrate various views and internal elements of an antenna suitable for use in the antenna diversity system of FIG. 9.
Figure 11:
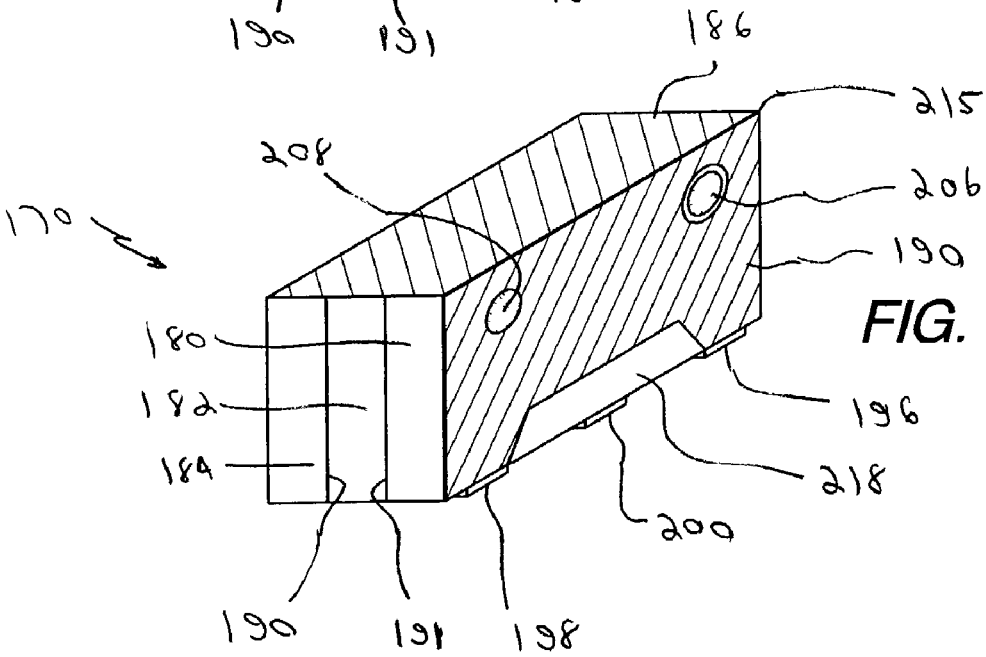

FIGS. 10 and 11 illustrate a low profile dielectrically loaded meanderline antenna 170 suitable for use as either or both of the antennas 149 and 150 of FIG. 9. The antenna 170 is constructed of three dielectric layers 180, 182 and 184, a top plate 186, a feed plate 188 and a ground plate 190. By using the dielectric material to load the antenna, as compared to an air-loaded antenna, the overall antenna size is reduced for a given operational frequency. Also, it is not required that the three layers 180, 182 and 184 have equal dielectric constants. In one embodiment the dielectric layer 182 is composed of a material with a higher dielectric constant to increase the effective electrical length of the antenna 170 without increasing its physical dimensions. The dielectric layers 180 and 184 have patterned conductive material on the interior-facing surface thereof, i.e., referred to as patterned surfaces 192 and 194, respectively, as described further below. Preferably, the middle dielectric layer 182 has no conductive surfaces.

Loading the meanderline antenna 170 with a solid dielectric material allows the employment of repeatable manufacturing steps, which in turn provides improved quality control over the various antenna dimensions and assures realization of the expected level of antenna performance. Printed circuit board fabrication techniques (e.g., masking, patterning and etching) are employed to form the patterned layers 180 and 184, and the various conductive surfaces of the antenna 170.

To provide an antenna ground plane surface, the ground plate of the antenna 170 contacts the ground plane of the printed circuit board 154, by way of ground contacts 196 and 198 on the antenna bottom surface. The signal is fed to or received from the antenna 170 through the feed contact 200 on the bottom surface of the antenna 170.

The patterned conductive feed plate 188 is formed preferably by etching conductive material from the outer surface of the dielectric layer 184. The antenna 170 further includes two vias 206 and 208. The via 206 is electrically connected to the feed plate. The via 208 is conductively isolated from the feed plate 188 by an intervening gap 210, but is electromagnetically coupled to the feed plate 188 due to the proximity to the conductive material of the feed plate 188.

The top plate 186 is electrically connected to a continuous conductive strip 212 extending along the front surface of the dielectric layer 184 above an upper edge 214 of the feed plate 188. Due to the proximity between the conductive strip 212 and the feed plate 188, there exists electromagnetic coupling between these two elements.

The rear surface of the antenna 170 is illustrated in FIG. 11, including the patterned ground plate 190 disposed on the outwardly facing surface of the dielectric layer 180. The via 208 is conductively connected to the ground plate 190, and the via 206 is electromagnetically coupled thereto. The ground plate 190 is also electrically connected to the top plate along an edge 215 where these two elements contact. Note a cut-out region 218 of the ground plate 190 avoids electrical contact between the ground plate 190 and the feed contact 200 extending along the bottom surface of the antenna 170.

Although specifically-shaped feed and ground plates 188 and 190, respectively, are shown in FIGS. 10 and 11, it is known by those skilled in the art that other geometric shapes will also produce desired antenna operational characteristics.

Figure 12:
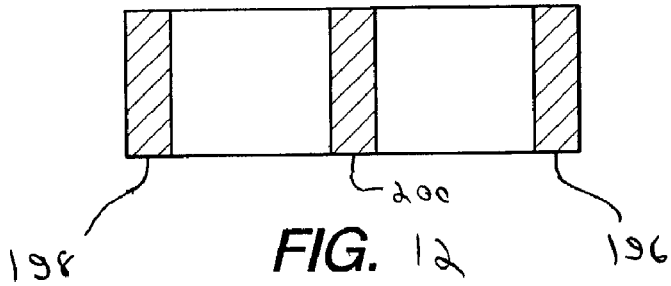

The ground contacts 196 and 198 and the feed contact 200 are located on the bottom surface as also shown in the bottom view of FIG. 12. The ground contacts 196 and 198 are conductively connected to the antenna ground plate 190 and the feed contact 200 is conductively connected to the feed plate 188. Advantageously, the antenna can be placed (by known pick and place assembly machines) onto a patterned printed circuit board, such as the printed circuit board 154 of FIG. 9, such that the ground contacts 196 and 198 and the feed contact 200 mate with the appropriate traces on the board 154 and then the antenna 170 is soldered into place by a solder reflow or wave solder operation.

Figure 13:
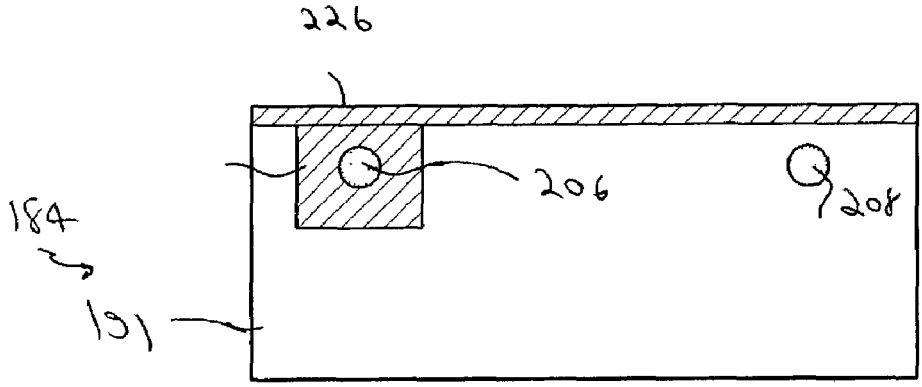

Exemplary conductive patterns for patterned surfaces 190 and 191 are shown in FIG. 13. On the surface 191, the via 206 is surrounded by and electrically connected to a pad 224, which in turn is electrically connected to a continuous conductive strip 226. The conductive strip 226 provides electrical connection between the via 206 and the surrounding pad 224, to the top plate 186. The via 208 simply passes through the dielectric layer 184.

Figure 14:
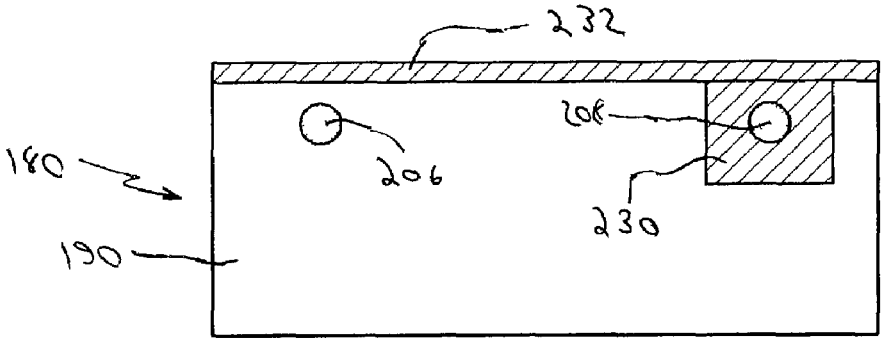

The details of the patterned surface 190 are illustrated in FIG. 14. The via 206 passes therethrough, while the via 208 is connected to a pad 230 that is in turn connected to a conductive strip 232 formed (preferably by etching away conductive material) along the top edge of the patterned surface 190. The conductive strip 232 also provides an electrical connection to the top plate 186. In addition to the conductive connection between the vias 206 and 208 and the top plate 186, both are electromagnetically coupled to the top plate 186 since they are located proximate thereto.

The meanderlines of the low profile dielectrically loaded meanderline antenna 170 are non-symmetric because the only electrical connection from the feed plate 188 to the top plate 186 is by way of the via 206. Whereas the ground plate is connected both directly to the top plate 186 along the line 214 and further connected to the top plate 186 through the via 208.

Figure 15:
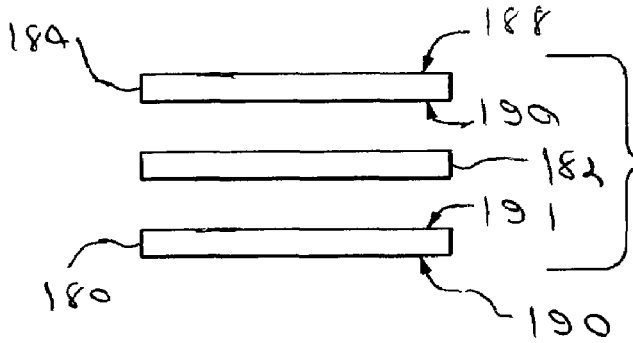

FIG. 15 is an exploded view of the three dielectric layers 180, 182 and 184, and indicates the location of the patterned surfaces 190 and 191, the feed plate 188 and the ground plate 190.

Fabrication of the antenna 170 employs conventional masking, patterning and etching process after which the dielectric layers 180, 182 and 184 are laminated together. Further details of the process are set forth in the patent application referenced below. Automated pick and place machines place the antenna 170 on the printed circuit board 154. A reflow soldering process electrically connects the ground and feed contacts to the appropriate traces on the board.

One embodiment of the antenna 170 is approximately 0.2 inches deep, 0.6 inches wide and 0.18 inches high. This antenna operates at a center frequency of approximately 5.25 GHz with a bandwidth of approximately 200 MHz. The bandwidth and center frequency can be adjusted by changing the distance between the vias 206 and 208 and/or changing the distance between the top plate 186 and each of the vias 206 and 208. This embodiment of the antenna 170 radiates a vertically polarized signal.

Figure 16:
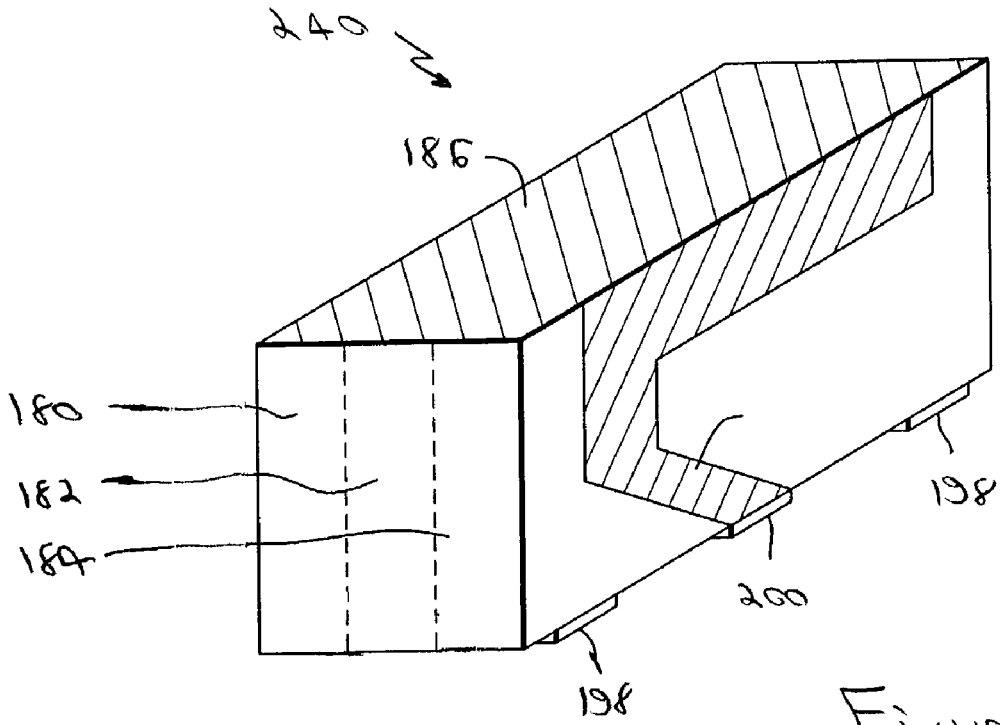
FIG. 16 illustrates an antenna suitable for use in the antenna diversity system of FIG. 9.

FIG. 16 illustrates a low profile dielectrically loaded meanderline antenna 240 suitable for use as either or both of the antennas 149 and 150 of FIG. 9. The antenna 240 is similar to the antenna 170 of FIG. 10, absent the vias 206 and 208 and having different conductive patterns on the interior surfaces of the three dielectric layers 180, 182 and 184. Also, the patterned conductive feed plate 188 is replaced by a feed plate 242 having a different conductive pattern thereon.

Further details of the a low profile dielectrically loaded meanderline antennas 170 and 240 can be found in commonly-owned patent application Ser. No. 10/160,930 filed on May 31, 2002 and entitled A Low Profile Dielectrically Loaded Meanderline Antenna, which is hereby incorporated by reference.

Figure 17:
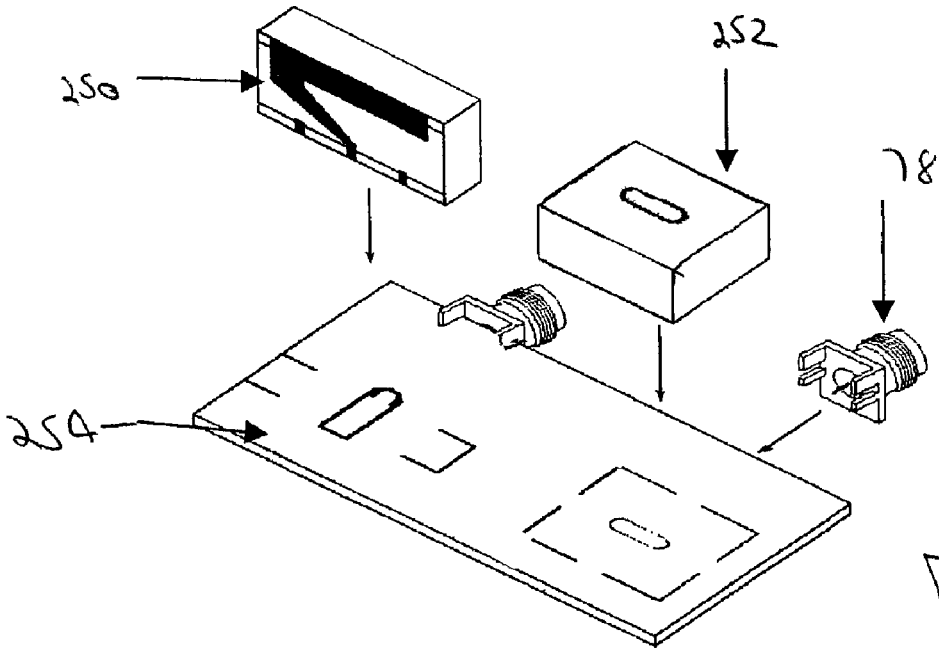
FIG. 17 illustrates yet another embodiment of an antenna diversity system according to the teachings of the present invention.

FIG. 17 illustrates a radiation pattern diversity and signal polarization diversity system where an antenna 250 has a highly linearly polarized pattern toward the zenith. For example, one embodiment of the antenna 250 comprises the antenna 170 of FIG. 10. An antenna 252 comprises a monopole antenna producing a donut radiation pattern with the axis of the donut perpendicular to a printed circuit board 254, on which both the antennas 250 and 252 are mounted. Thus the combined radiation patterns produces a hemispherical coverage pattern, and this embodiment is referred to as a switched hemispherical radiation pattern diversity antenna. Since the individual patterns minimally overlap, the combination provides a larger overall antenna pattern. This embodiment is recommended for applications where the communications system requires a high antenna gain over a hemispherical or spherical area. Additional antenna elements, such as the antennas 12 and 14 of FIG. 1 or the antenna 76 of FIG. 3 can be added to the embodiment of FIG. 16 or used in lieu of the antennas 250 and 252, to provide signal polarization diversity within the pattern diversity.

In the FIG. 17 embodiment, the printed circuit board 254 carries a ground plane. The operative antenna of the antennas 250 and 252 is selected by the control circuitry 22 according to predetermined signal metrics as described above.

Figure 18:
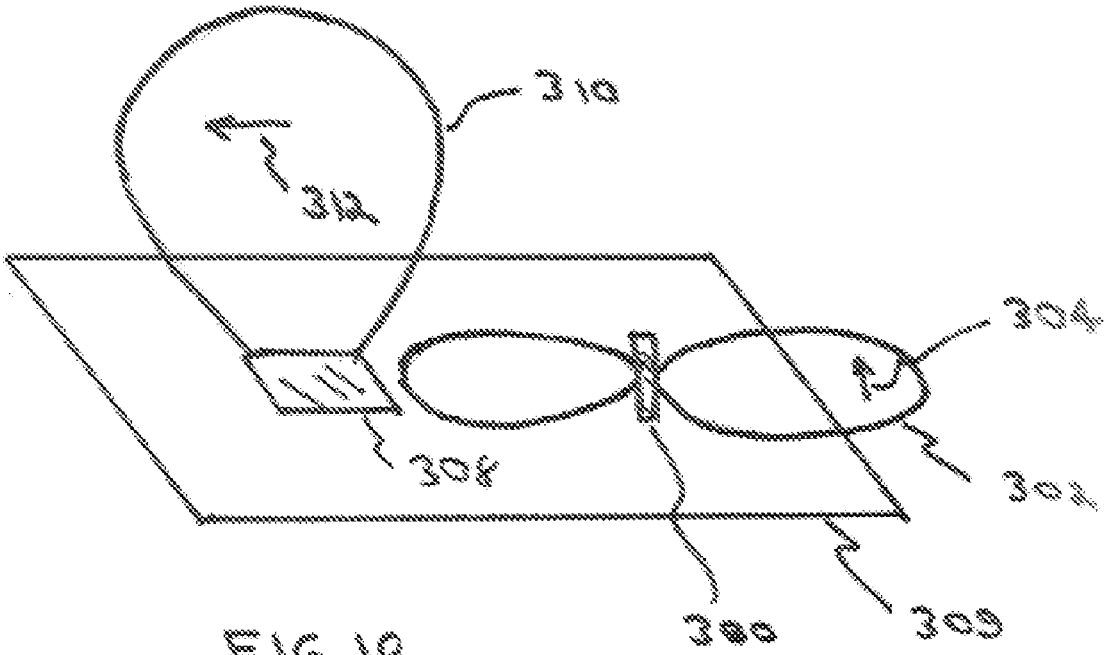
FIG. 18 illustrate two antennas having different radiation patterns and signal polarization characteristics according to the teachings of the present invention.

FIG. 18 schematically illustrates an antenna 300 having a pattern 302 and a signal polarization characteristic indicated by an arrowhead 304. An antenna 308, mounted on a common substrate 309 with antenna 300, has a radiation pattern 310 and a signal polarization characteristic indicated by an arrowhead 312. As illustrated, the radiation patterns and the signal polarization characteristics for the antennas 300 and 308 are different.

Thus according to the present invention a plurality of antennas are employed at a receiving or transmitting station to provide signal polarization, spatial and/or radiation pattern diversity. The operative antenna is selected to maximize a signal quality metric (or minimize the metric depending on the selected metric).

Although the various embodiments presented herein preferably operate in a switched diversity mode, in another embodiment, both antennas can be simultaneously operative to receive or send a signals such that the composite signal, due to the combination of the radiation patterns and/or signal polarizations, has the desired characteristics.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from the essential scope thereof. For example, different combinations of the antennas presented herein can be utilized to accommodate the requirements of the communications system. Therefore, it is intended that the invention not be limited to the particular embodiment disclosed as the best mode contemplated for carrying out this invention, but that the invention will include all embodiments falling within the scope of the appended claims.

What is claimed is:

1. An antenna system comprising at least two antennas for providing diversity operation, the antenna system comprising:

a first antenna having first signal polarization characteristic and a first radiation pattern shape;

a second antenna, independently excitable from the first antenna at a different time, the second antenna exhibiting a second signal polarization characteristic and a second radiation pattern shape, the first signal polarization characteristic having a different orientation than the second signal polarization characteristic and the first radiation pattern having a different shape than the second radiation pattern; and wherein the signal polarization and radiation pattern presented by the antenna system are selectable, wherein the antenna system transmits a first signal with the first signal polarization characteristic and the first radiation pattern shape when the first antenna is excited or transmits a second signal with the second signal polarization characteristic and the second radiation pattern shape when the second antenna is excited.

2. The antenna system of claim 1 wherein the first signal polarization characteristic is selected from among vertical signal polarization, horizontal signal polarization and circular signal polarization.

3. The antenna system of claim 1 wherein the first radiation pattern shape is selected from among an omnidirectional pattern, an elevation pattern and an isotropic pattern.

4. The antenna system of claim 1 wherein the first and the second antennas are mounted on a planar structure, and wherein the first and the second antennas are connected to a common ground plane disposed on the planar structure.

5. The antenna system of claim 4 wherein the planar structure comprises a printed circuit board.

6. The antenna system of claim 1 wherein the first and the second antennas are spaced apart to provide spatial diversity.

7. The antenna system of claim 1 further comprising a controller wherein the controller determines whether the first antenna or the second antenna is excited in response to a measured signal quality metric.

8. The antenna system of claim 7 wherein both the first antenna and the second antenna are operative in response to the measured signal quality metric.

9. The antenna system of claim 1 wherein the first and the second antennas are operative in a wireless local area network.

10. An antenna system comprising at least two meanderline antennas for providing diversity operation, the antenna system comprising:

a first meanderline antenna;

a second meanderline antenna oriented with respect to the first meanderline antenna to present a different signal polarization and radiation pattern with respect to the first meanderline antenna;

a controller for selecting the operative antenna from between the first meanderline antenna and the second meanderline antenna based on a provided signal quality metric, wherein a selected antenna is independently and separately excited such that the antenna system transmits a first signal having a first signal polarization orientation and a first radiation pattern shape when the first antenna is selected and having a second signal polarization orientation and a second radiation pattern shape when the second antenna is selected;

wherein the first and the second meanderline antennas are mounted on a planar structure, and wherein the first and the second meanderline antennas are connected to a common ground plane disposed on the planar structure.

11. The antenna system of claim 10 wherein the first and the second meanderline antennas are spaced apart to provide spatial diversity.

12. The antenna system of claim 11 wherein the first and the second meanderline antennas are spaced apart by a fraction of the operational wavelength to provide spatial diversity.

13. A antenna system comprising a plurality of antennas for providing diversity operation, the antenna system comprising:

a first pair of antennas having different signal polarization orientation characteristics from each other;

a second pair of antennas having different radiation pattern shape characteristics from each other; and a controller for determining an operative antenna from the first pair of antennas and for determining an operative antenna from the second pair of antennas such that the antenna system presents a desired signal polarization characteristic and a desired radiation pattern characteristic.

14. The antenna system of claim 13 further comprising a third pair of antennas in a spaced-apart orientation for providing spatial diversity.

15. The antenna system of claim 13 wherein the antennas of the first pair of antennas and the antennas of the second pair of antennas are spaced apart to provide spatial diversity operation.

* * * * *